United States Patent [19]

Dewaele et al.

[11] Patent Number: 4,817,675

[45] Date of Patent: Apr. 4, 1989

[54] METHOD FOR REPAIRING A BROKEN WARP THREAD ON WEAVING MACHINES, AND THE RETHREADING MECHANISMS USED

[75] Inventors: Stefan Dewaele, Kortrijk; Dirk Gryson, Dikkebus-Ieper, both of Belgium

[73] Assignee: Picanol N.V., Belgium

[21] Appl. No.: 90,510

[22] Filed: Aug. 28, 1987

[30] Foreign Application Priority Data

Aug. 28, 1986 [NL] Netherlands ..... 8602192

[51] Int. Cl.[4] ..... D03J 1/14

[52] U.S. Cl. ..... 139/35; 28/209; 28/211

[58] Field of Search ..... 139/1 R, 35, 336 R; 28/201, 208, 209, 210, 211

[56] References Cited

U.S. PATENT DOCUMENTS 3,867,745 2/1975 Crandall ..... 28/211
4,321,736 3/1982 Rohner ..... 28/210

FOREIGN PATENT DOCUMENTS 0158933 10/1985 European Pat. Off. .
2109426 6/1983 United Kingdom .

*Primary Examiner*—Henry S. Jaudon
*Attorney, Agent, or Firm*—Bacon & Thomas

[57] ABSTRACT

A method and mechanism for repairing warp thread breaks in a weaving loom in which a broken warp thread is detected by a fallen drop wire of a warp stop motion device, the method comprising: upon the falling of a drop wire, taking a new warp thread from a supply of warp thread separate from the loom supply of warp thread, and moving the new warp thread to a position between the warp stop motion device and the harness of the loom by a rethreading mechanism; raising the fallen drop wire and threading a first end of the new warp thread through the raised drop wire by the rethreading mechanism; and threading a second end of the new warp thread through a heddle of the harness corresponding to the broken warp thread.

17 Claims, 8 Drawing Sheets

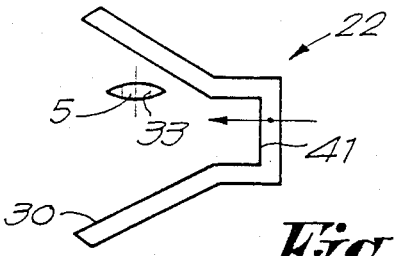
Fig. 13
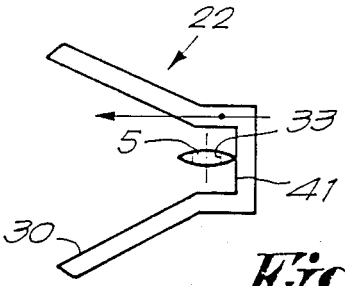
Fig. 14
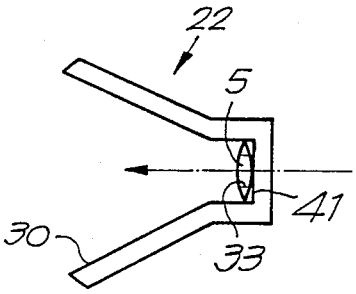
Fig. 15
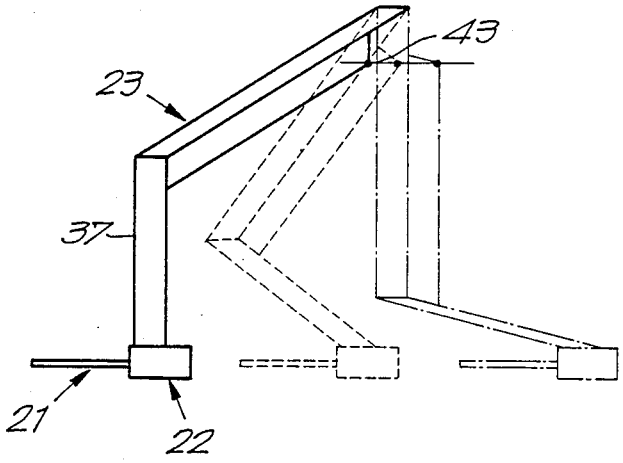
Fig. 19
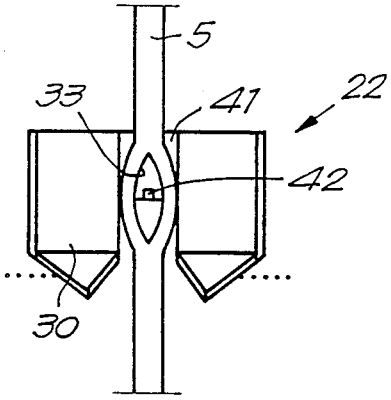
Fig. 17
Fig. 20
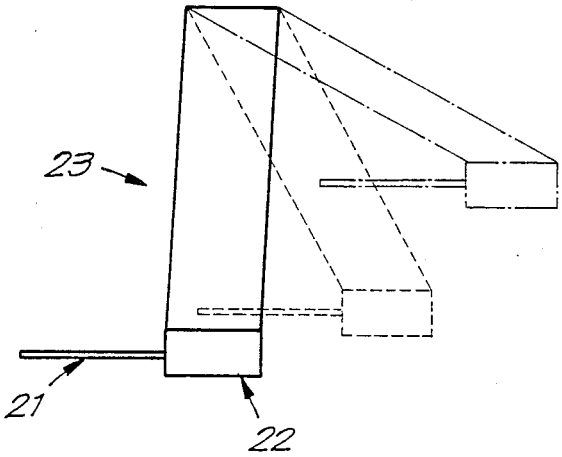

METHOD FOR REPAIRING A BROKEN WARP THREAD ON WEAVING MACHINES, AND THE RETHREADING MECHANISMS USED

BACKGROUND OF THE INVENTION

The object of this invention concerns a method for repairing a warp break on weaving machines, together with the rethreading mechanisms used for this purpose.

As is well known, the warp threads on a weaving machine are led in turn through a warp stop motion device for detecting warp thread breaks, the harnesses and the reed. The warp stop motion device is made up of a series of drop wires; each drop wire is supported by one of the warp threads, so that if the thread breaks the drop wire falls and an electrical contact is made. The harnesses control the motion of the warp threads; they are made up of a series of heddles, each of which controls the motion of a single warp thread. The reed is used for beating up the weft threads in the normal way.

Clearly, given the large number of warp threads and consequently the same large number of drop wires and heddles, when a warp break occurs it is farily difficult to carry out a repair. The break first has to be located, then space has to be made in order to carry out the repair, and finally the repair has to be made. The first of these requirements is dealt with in the U.S. Pat. No. 4,791,967, filed Feb. 13, 1987, and assigned to the assignee of the present application and incorporated herein by reference. Concerning the second requirement, ie. to make space for access to the fallen drop wire and the area around it, use is made of a method and mechanism for twisting the drop wire. This method and the mechanism are described the U.S. patent application Ser. No. 072,003, filed July 10, 1987, and assigned to the assignee of the present application and incorporated herein by reference. The present invention concerns the third requirement, ie. the repair itself. In particular, the invention provides a method for repairing a warp break on weaving machines in such a way as to enable the subsequent rethreading to be carried out automatically, thus saving a great deal of time and trouble.

SUMMARY OF THE INVENTION

For this purpose, the object of the present invention is a method of operation which essentially consists of drawing a new warp thread from a separate supply and leading it into the area between the warp-stop motion device and the harnesses; by means of a rethreading mechanism located between the drop wires and the harnesses, one end of this new thread is then threaded through the fallen drop wire after it has been raised, and other end is threaded through the heddle corresponding to the broken warp thread, and if necessary also through the corresponding gap between the reed dents. One end of the new warp thread threaded through the raised drop wire can then be joined to the broken warp end by means of a tying-in device located before the drop wires in the direction of warp travel, and the other end can be woven into the cloth in the usual way by the reed.

The invention also concerns the rethreading mechanisms which can be used in the method of the invention. In a preferred embodiment, this mechanism consists essentially of: a warp thread supply separate from the loom supply of warp thread; a first threading device to thread the drop wire; a second threading device directed opposite to the first threading device for threading the heddles in the harnesses; and a positioning mechanism located between the stop motion device and the heddles which moves the threading devices jointly back and forth between the warp stop motion device and the harnesses, in order to carry out the threading operations just described.

BRIEF DESCRIPTION OF THE DRAWINGS

In order to explain the characteristics of the invention, by way of example only and without being limitative in any way, the following preferred embodiments are described with reference to the accompanying drawings, where:

FIGS. 13 to 15 show a different embodiment of the part shown in FIG. 10, with the steps of its operation;

FIGS. 17 and 18 show yet another embodiment of the device in FIGS. 13 to 15;

FIG. 19 is a schematic representation of the freedom of motion of the rethreading mechanism in FIG. 9;

FIG. 20 shows yet another embodiment of the rethreading mechanism in FIG. 9;

DETAILED DESCRIPTION OF THE PREFERRED EMBODIMENTS

Figure 1:
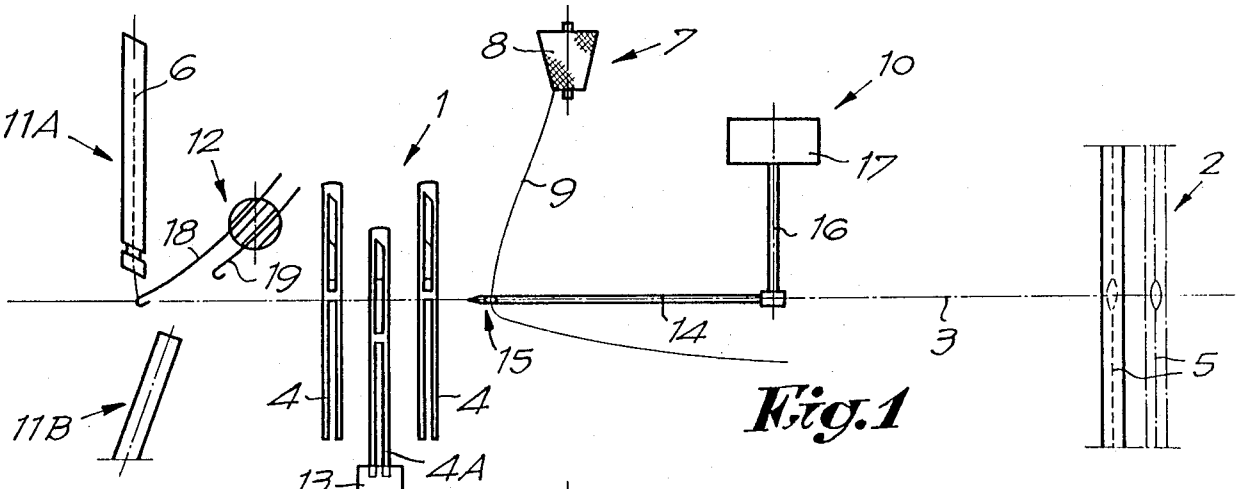
FIGS. 1 to 8 show the steps of the method used in the invention.

FIG. 1 show schematically the traditional configuration of a warp stop motion device 1, harnesses 2, warp threads 3 and drop wires 4. For each warp thread 3, of the warp stop motion device 1 there is a drop wire 4 which falls whenever the associated warp thread 3 breaks, so that the fallen drop wire 4A makes an electrical contact in a manner disclosed in U.S. Pat. No. 4,791,967. The harnesses 2 are fitted with heddles 5 in the normal way.

When a warp break occurs, two loose warp thread ends are formed from the broken thread, namely a first warp end 6 on the warp beam side, a second warp end (not shown in the figures) attached to the cloth. The method used to repair the broken warp thread 3 according to the invention consists essentially of a separate warp thread supply 7, for example a bobin 8, located between the warp stop motion device 1 and the harnesses 2; after detection of a broken warp thread such as in the manner disclosed in Ser. No. 014,788, the new warp thread 9 is led successively through the fallen drop wire 4A after it is raised to its normal position and then through the harness 2, in particular through the heddle 5 corresponding to the broken warp thread 3. This is done using a rethreading mechanism 10, which may be mounted to the loom structure in a stationary position between the stop motion device 1 and the harnesses 2, or mounted to a separate structure in a stationary position relative to the loom in a position between the stop motion device 1 and the harnesses 2. On detecting a broken warp thread such as in the manner disclosed in U.S. Pat. No. 4,791,967, the rethreading mechanism is automatically controlled by position unit 17 to move into a position between the warp stop motion device 1 and the harnesses 2. Also responsive to the detection of a broken warp are a number of automatically controlled auxiliary devices such as two suction devices 11A and 11B, a tying-in device 12 located before the stop motion device in the direction of warp travel, and a resetting device 13 that repositions the fallen drop wire 4A such as that disclosed in application Ser. No. 072,003, plus various other auxiliary devices as required.

The rethreading mechanism 10, in the embodiment shown in FIG. 1, consists essentially of a needle 14 with an eye 15 near its front end, through which the thread 9 is threaded. The needle 14 lies in a horizontal plane when it is in its normal position; however it can swing through 180° in a plane which may be freely chosen. For instance, the needle may swing about shaft 16. The needle 14 also has a positioning mechanism 17 which enables it to be moved parallel to the direction of the of the warp threads 3 to predetermined positions for threading the drop wires and heddles. The rethreading mechanism 10 is of course attached to a movable mounting which enables it to be positioned above the warp threads at the correct place for it to operate, ie. at the point of the break. In order for the rethreading mechanism to be positioned, the warp threads 3 around the broken end are pulled apart in a manner such as that disclosed in application Ser. No. 072,003, and the rethreading mechanism is lowered into the space thus created.

Figure 2:
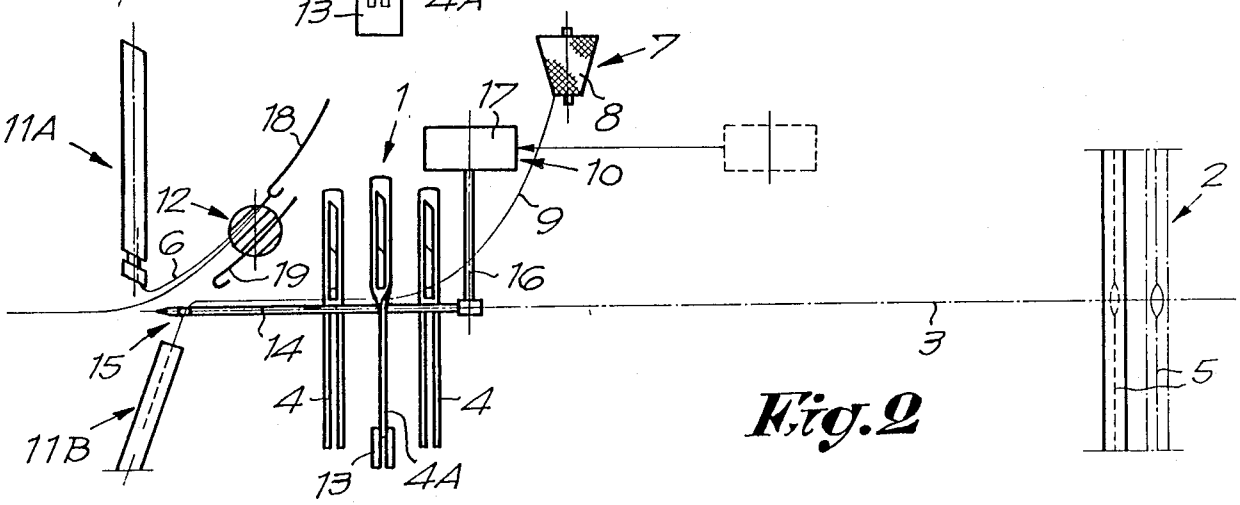
Figure 3:
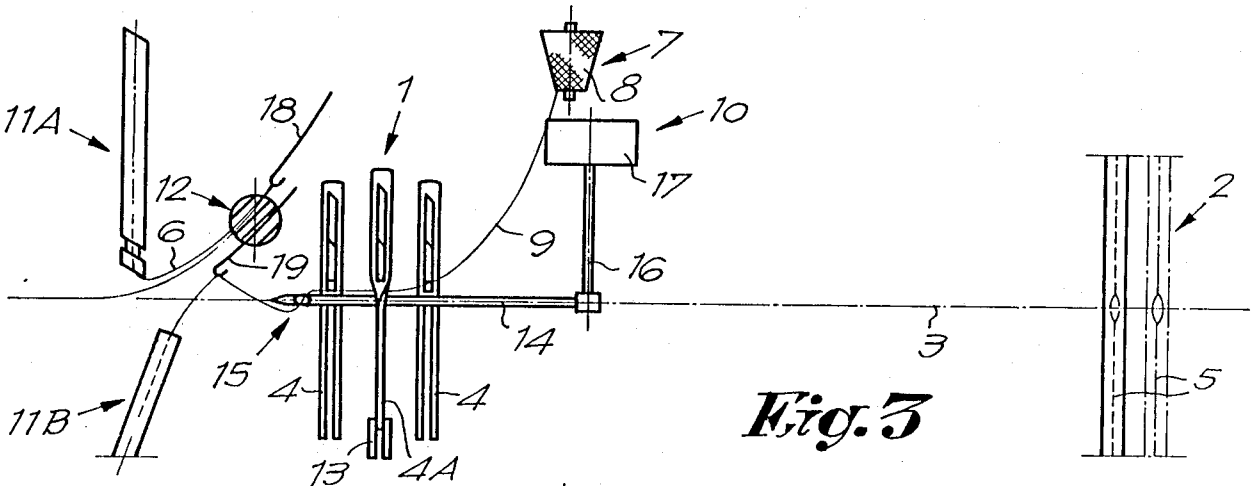
Figure 4:
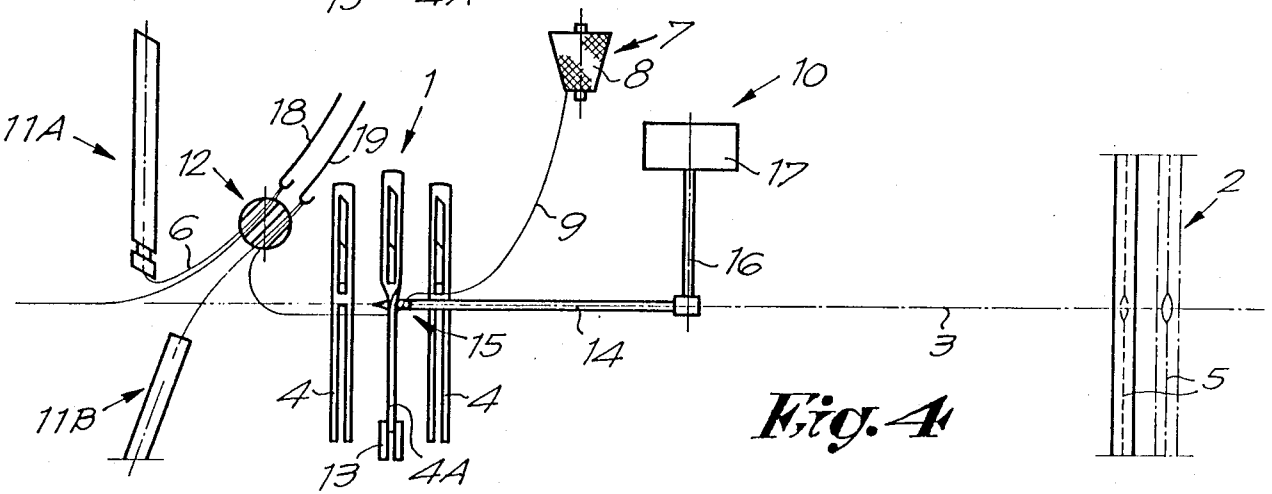
Figure 5:
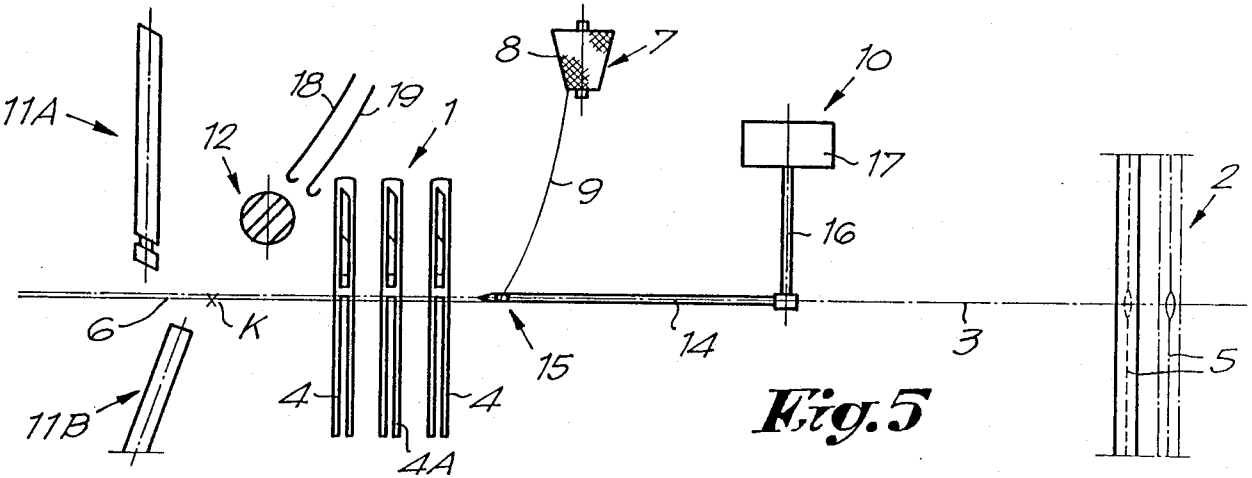

The steps involved in repairing the broken warp thread 3 are shown in FIGS. 1 to 8. In FIG. 1, on detecting a broken warp thread in a manner such as that disclosed in application Ser. No. 014,788, the broken end 6 is sucked away from the other warp threads 3 by means of an automatically controlled suction device 11A; the end 6 is then drawn into the tying-in device 12 by means of eg. an automatically controlled hook 18. The fallen drop wire is gripped by the resetting device 13 in the normal way and then raised in a manner such as that disclosed in application Ser. No. 072,003. The weft end 6 is led into the tying-in device 12 as shown in FIG. 2. The corresponding drop wire 4A is raised and at the time twisted through a certain angle in order to facilitate the rethreading. The method of twisting the drop wire 4A is described in the above-mentioned patent application Ser. No. 072,003 made by the present applicant. Also as shown in FIG. 2, the new warp thread 9 is led through the drop wire 4A by needle 14, by means of the automatically controlled, predetermined movement of positioning mechanism 17. The free end of the new warp thread 9 is then sucked in and held by the second suction device 11B. As shown in FIGS. 3 and 4, the end of the new thread 9 is led into the tying-in device 12 by means of a second hook 19. The ends are then joined together and the needle 14 is then withdrawn from the warp stop motion device 1. The joined thread is shown in FIG. 5, where the join is indicated by the letter K.

Figure 6:
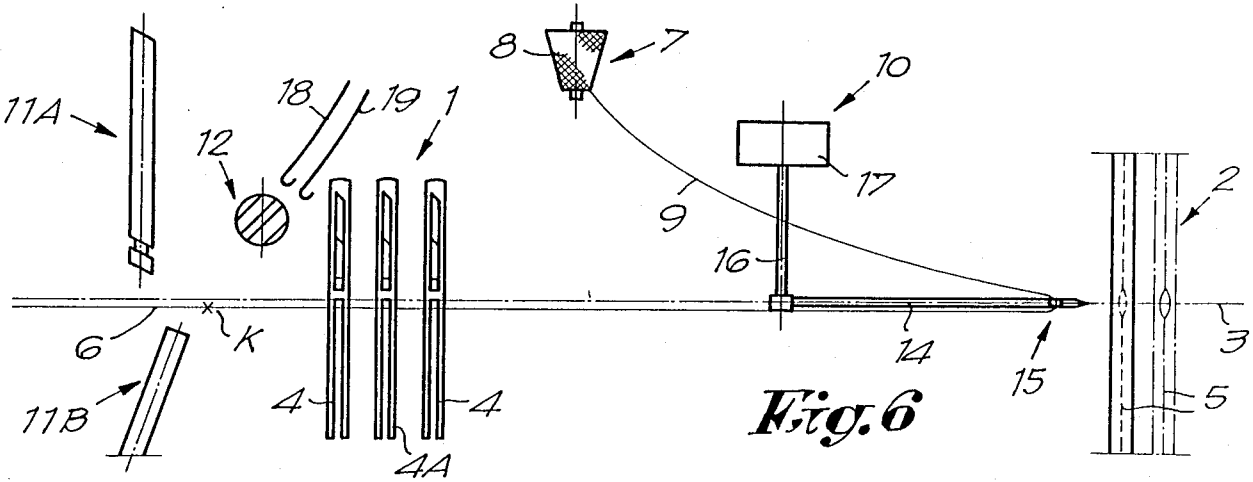
Figure 7:
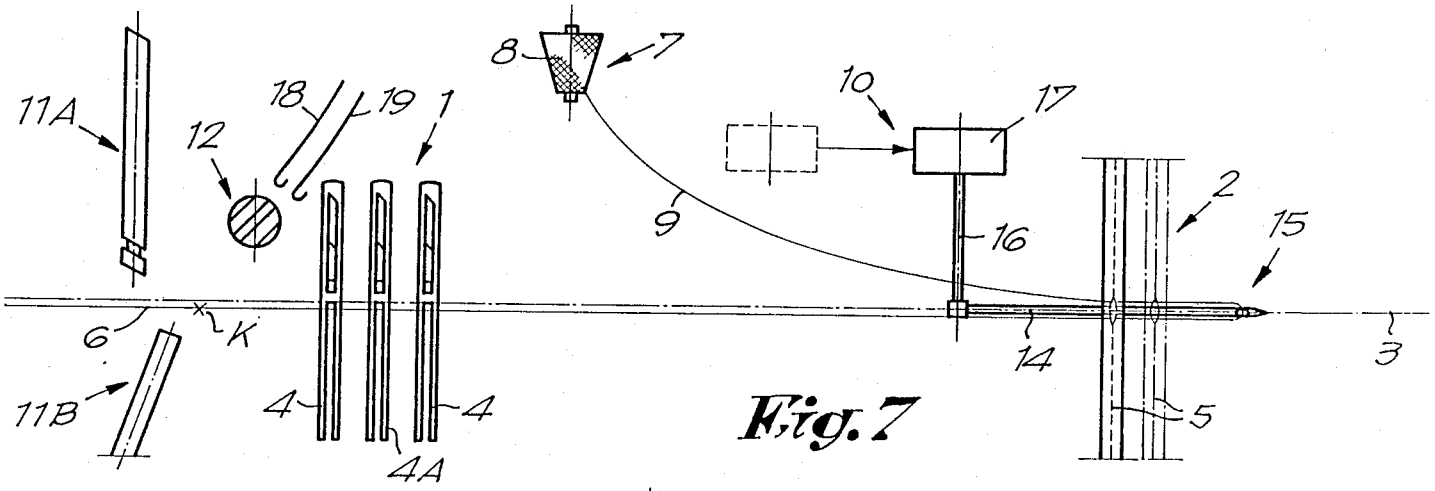

In the next stage, shown in FIG. 6, the needle 14 is automatically controlled to swing through 180°. Then, as shown in FIG. 7, it is led through the corresponding heddle 5, after the correct heddle has been selected. Once the new warp thread 9 has been threaded, it is taken on the other side of the harnesses 2 by a suitable device, such as a hook 20.

Figure 8:
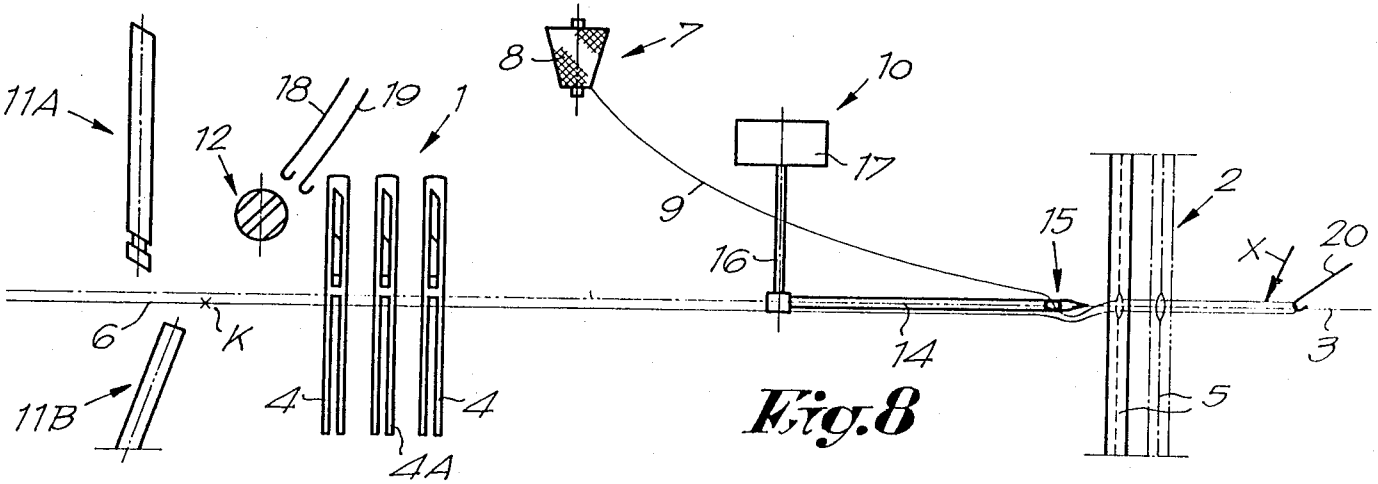

Then, as shown in FIG. 8, the needle 14 is automatically controlled to be drawn back through the harnesses 2, while the new thread 9 remains held by the hook 20. The new thread 9 is then cut off at the point indicated by arrow X. This gives a warp end which can be then led through the reed by means of eg. an automatically controlled hook or blower device in order for it to be woven into the cloth, while preventing the new thread 9 slipping out of the eye 15 when it is cut off. Finally, the rethreading mechanism 10 returns to its original position.

The advantage of the rethreading mechanism 10 just described is that the needle 14 does not have to be rethreaded each time.

If the warp stop motion 1 is mounted at an angle, the orientation of the needle 14 can of course be adjusted, or the orientation can be set permanently in order to compensate for the angle. The rethreading mechanism 10 can be withdrawn temporarily from between the warp stop motion 1 and the hardnesses 5 to enable the needle 14 to swing through 180°.

Figure 9:
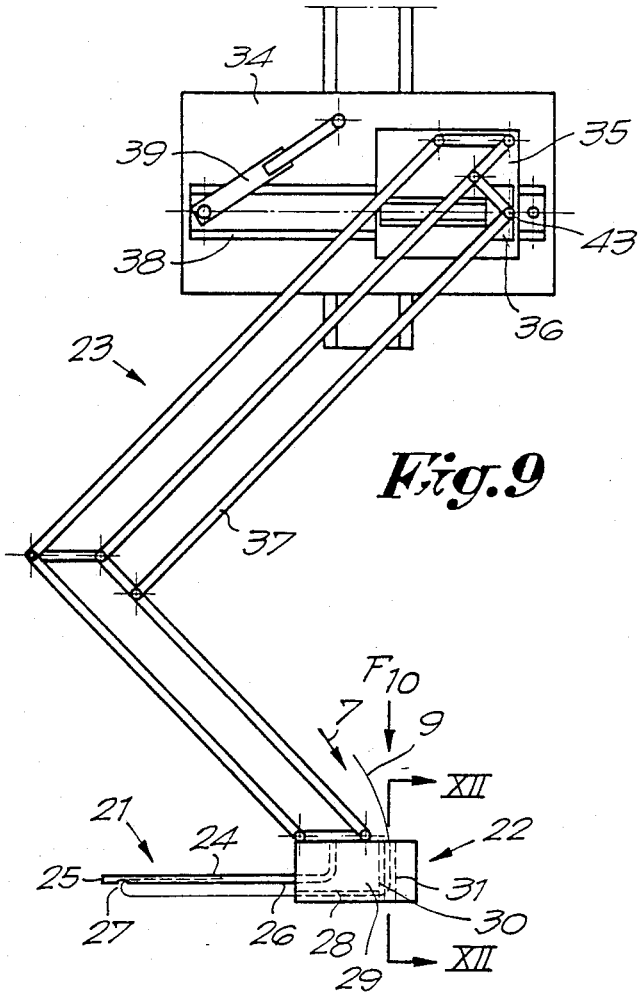
FIG. 9 shows a rethreading mechanism described as part of the invention.

FIG. 9 shows yet another embodiment of a rethreading mechanism for use with the invention, consisting essentially of: a thread supply 7; a first threading device 21 to thread the drop wires 4; a second threading device 22 opposite to the first, to thread the heddles 5 of the harness 2; and a positioning mechanism 23 which is also automatically controlled on detection of a broken warp thread to move the threading devices 21 and 23 jointly back and forth between the warp stop motion device 1 and the harnesses 2 in the same manner as described with reference to FIGS. 1–8.

The first threading device 21 consists of a hollow tube 24 with one closed end 25 and the other end 26 fitted with a suction device (not shown in the figure). Near the end 25 there is an opening 27 in the side of the hollow tube 24. The new thread 9 is led from the thread supply 7 along a half-open channel 28 until it comes out underneath the tube 24, so that the end of the thread is sucked through opening 27.

Figure 10:
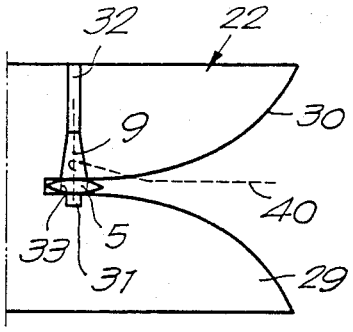
FIG. 10 is a view in the direction of arrow F10 in FIG. 9.

The second threading device 22 consists essentially of a device 29 with a vertical, V-shaped recesses 30 on the side facing the hollow tube 24. As shown in FIG. 10 the new thread is led from the thread supply 7 through a channel 31 in the side of the V-shaped recess 30. In the other side of the recess opposite the channel is a suction opening 32, positioned so that when a heddle 5 is brought into the recess 30 it lies with its eye 33 in line with the channel 31 and just opposite the suction opening 32.

The positioning mechanism 23 consists essentially of a number of slides 34 to 36 and a pantograph 37. The two threading devices 21 and 22 are mounted on the lower end of the pantograph. Slide 34 provides the vertical positioning, while slide 35 and the pantograph 37 provide the transverse motion. The angle of the guide 38 of slide 35 can be set by means of adjustment 39, so that the transverse motion can be at an angle. Slide 36 enables the pantograph 37 to travel. The slides 34 to 36 are of course provided with the necessary drives which are automatically controlled on detection of a broken warp thread to move the first and second threading devices to predetermined positions relative to the loom to carry out the repair of the broken warp thread.

The rethreading mechanism 10 shown in FIG. 9 is of course mounted on a mechanism which enables it to travel across the whole weaving width.

Figure 12:
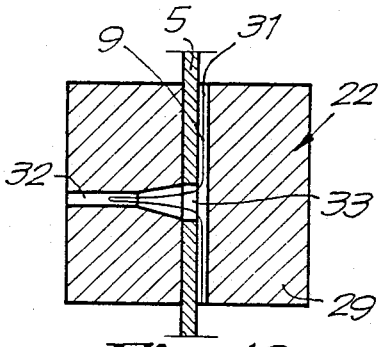
FIG. 12 shows a cross-section along the line XII—XII in FIG. 9.
Figure 11:
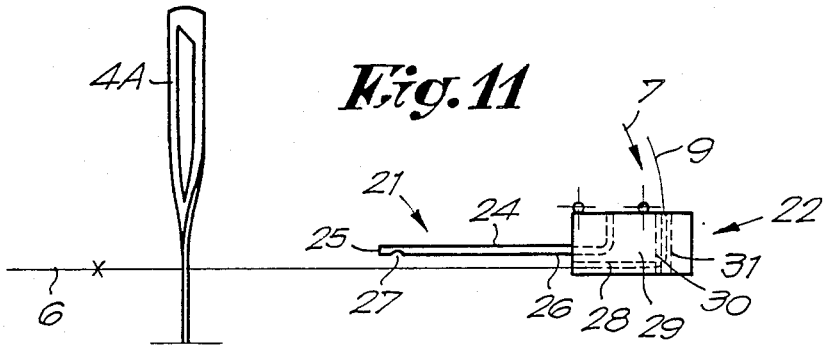
FIG. 11 shows how the drop wires are threaded by means of the mechanism in FIG. 9.

The operation of the rethreading mechanism 10 as shown in FIG. 9 is essentially as follows. When a warp break is detected, the rethreading mechanism 10 is automatically moved into a position above the break. The warp threads 3 surrounding the break are drawn apart in the usual way such as that disclosed in application Ser. No. 072,003 in order to form an opening. The rethreading mechanism is then automatically lowered into the opening by means of the slide 34, so that the threading devices 21 and 22 are positioned at about the height of the warp threads 3. As a result of the predetermined movements of the positioning mechanism 23, the hollow tube 24 is inserted through the drop wire 4A, and the new thread 9 is drawn through the opening 27. The new thread 9 is then joined to the broken end 6 in the usual way such as that described with reference to FIGS. 1–8. The tube 24 is withdrawn from the warp stop motion device 1, resulting in the set-up shown in FIG. 11. The second threading device 22 is then moved by the pantograph 37 towards the empty heddle 5, so that the heddle 5 lands in the V-shaped recess 30 as shown in FIG. 10. Suction is then applied to the suction opening 32, so that the new thread 9 is looped through the eye 33 of the heddle 5, as shown in FIG. 12. The rethreading mechanism 10 then returns to its original position, but in the meantime the new thread 9 remains looped through the heddle eye 33. The new thread 9 is then cut off at the thread supply 7 by a cutting device (not shown); the loop formed in the heddle eye 33 can then be led through the reed dents by means of eg. a hook 40 or an airjet, and the end thus formed is woven into the cloth.

In another embodiment, the second threading device 22 can be constructed as shown in FIGS. 13 to 15. Once again, there is a V-shaped recess 30. The V-shaped recess 30 has a flat bottom 41 sufficiently wide to ensure that when the heddle 5 enters, the motion of the threading device 22 flips the heddle 5 round so that it rests flat against the bottom 41 of the recess 30, as shown in FIGS. 13 to 15.

Figure 16:
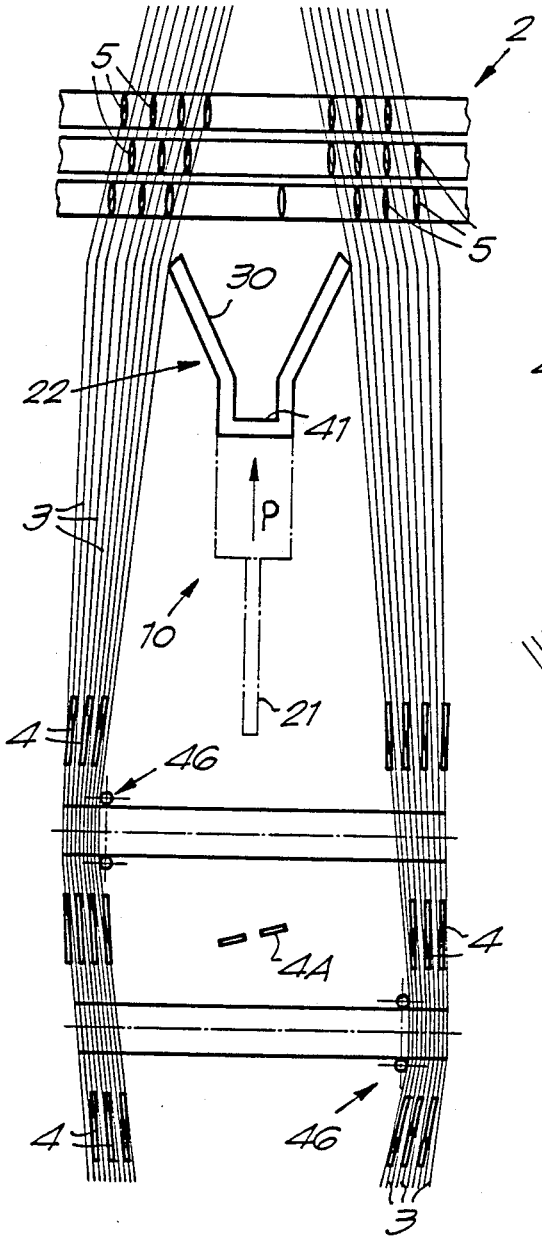
FIG. 16 shows the movement of the threading mechanism between the warp ends, in particular the movement of the device in FIGS. 13 to 15.

FIG. 16 shows how the second threading device 22 moves in the direction of the arrow P towards the harnesses 2, so that it pushes the warp threads 3 apart and isolates the corresponding heddle 5.

Figure 18:
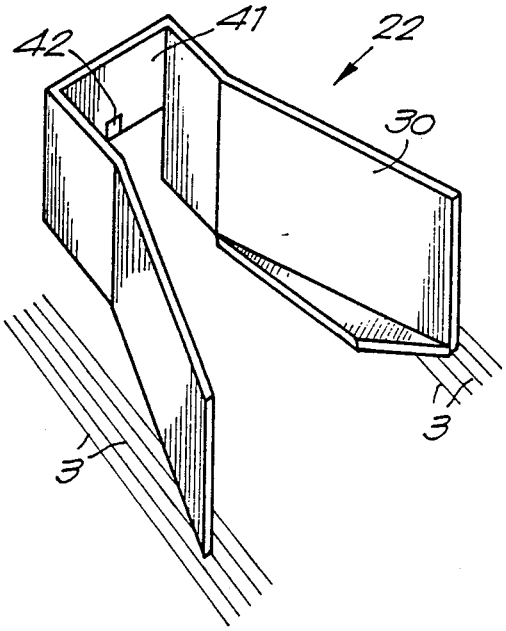

FIGS. 17 and 18 show yet another embodiment of the second threading device 22.

In this embodiment, a wedge shape on the lower side of the threading device 22 ensures that it is correctly inserted in the space created between the warp threads 3.

In the embodiments shown in FIGS. 13 to 18, threading of the heddle 5 can be accomplished by eg. leading the new thread 9 throughh the heddle eye 33 after the heddle 5 has been positioned in the V-shaped recess 30.

In each of the above embodiments of the second threading device 22, the side of the V-shaped recess 30 may also incorporate a detector 42 (shown only in FIGS. 17 and 18), for example a photocell. This detector 42 controls the vertical motion of the threading device 22 so that it is correctly positioned relative to the eye 33 of the heddle 5 in order for rethreading to be carried out.

Once the second threading device 22 has been correctly positioned relative to the heddle 5, threading can be carried out.

FIG. 19 illustrates the motion of the pantograph 37 by showing various positions. The motion of the slide 36, ie. the straight-line displacement of pivot 43, results in the threading devices 21 and 22 moving in a horizontal plane. In another embodiment, shown in FIG. 20, the same result can also be obtained by means of a positioning mechanism 23 consisting essentially of a parallellogram construction.

In addition to the device already mentioned, a number of auxiliary devices can of course also be located near to the cloth. For example, the free end of the warp thread formed on the cloth as a result of a warp break can be raised by means of a brush that rolls across the cloth, then sucked up and finally cut off against the cloth.

The point at which the new thread 9 is to be led through the reed is preferrably determined as follows, with reference to FIGS. 21 to 25. These figures show a number of reed dents 44, warp threads 3, harnesses 2A-2D and heddles 5A–5D. For the purposes of illustration the distances between the reed dents 44 have been exaggerated in the figures. The figures also show the broken warp end 45 which is still attached to the cloth. However, this free end can be located at any point.

As shown in FIGS. 21 to 25, the unbroken warp threads 3 and the corresponding reed dents 44 are separated on either side of the broke end. The initial separation occurs when the fallen drop wire 4A is isolated by the mechanisms 46 shown in FIG. 16, which pushes the surrounding drop wires 4 aside (this mechanism is described in patent application Ser. No. 072,003 assigned to the assignee of the present applicant). The reed dents 44, the warp threads 3 and the heddles 5 are then separated more when the V-shaped threading device 22 moves in the direction of the arrow P.

Figure 21:
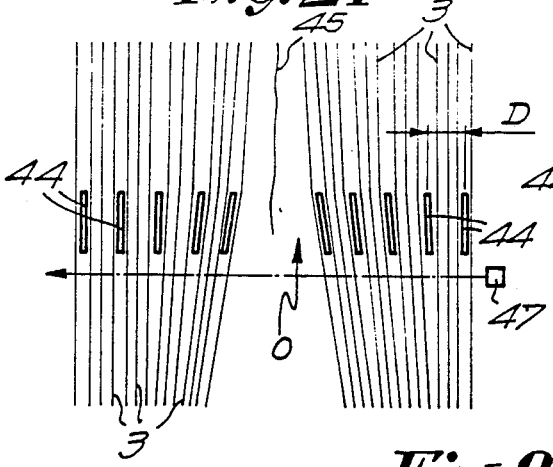
FIGS. 21 to 25 are schematic representation of the process of locating a broken warp end between the reed dents.

When the reed dents are drawn apart, a gap 0 is formed as shown in FIG. 21, or two gaps L and R may be formed as shown in FIGS. 22 to 25, with the width of the gaps being greater than the normal distance D between the reed dents 44. In the present invention, the location and the number of openings formed is found by a detector 47 which travels across the width of the reed. This detector 47 can be of any type, eg. optical, mechanical, proximity-sensitive etc. and is automatically controlled on detection of a warp thread break to locate the opening formed in the reed by the broken thread.

The following situations can then occur, depending on the number of warp threads between two adjacent reed dents, and depending also on which warp thread is broken.

If only one gap 0 is detected, as shown in FIG. 21, the new thread 9 must necessarily be led through that opening. If two gaps L and R are detected, two further cases have to be differentiated.

Figure 22:
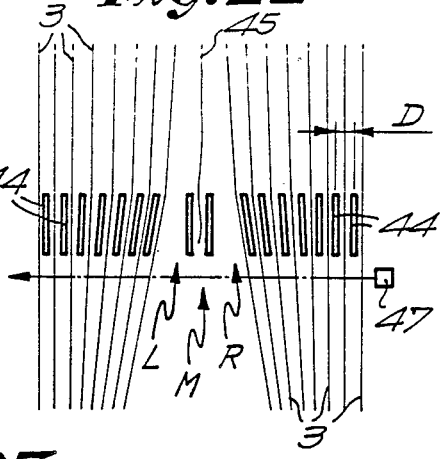

In the first case, shown in FIG. 22, there is only one warp thread 3 per gap between the reed dents 44. The point through which the new thread 9 must be led is uniquely defined by the normal reed gap M between the detected gaps L and R.

Figure 23:
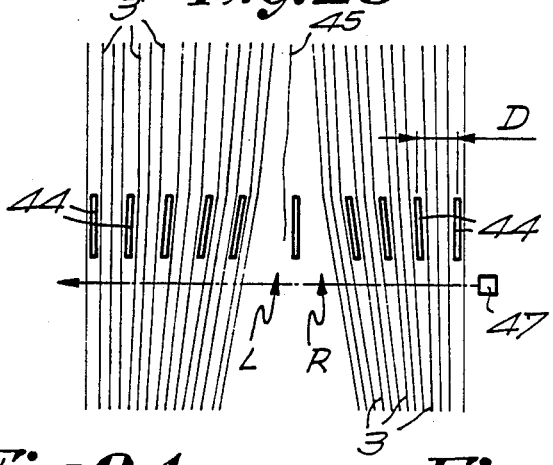

In the second case, shown in FIG. 23, there are several warp threads 3 per gap between the reed dents 44. The gap through which the new thread 9 has to be led, either the left-hand gap L or the right-hand gap R, is determined by counting the warp threads in the gaps L and R or by carrying out a thickness of volume measurement and so determining in which of these two gaps a thread is missing. The counting method used may be mechanical, optical, electronic or accoustic.

Figure 24:
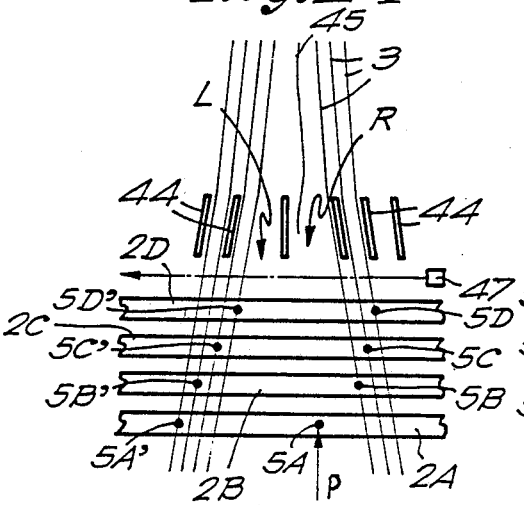
Figure 25:
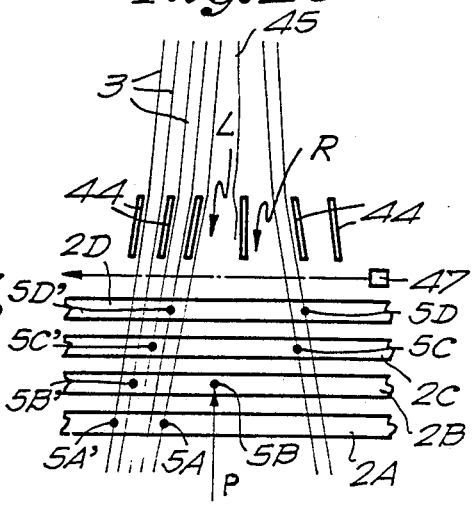

In some cases, in particular with a simple, regular weave, the gap through which the thread has to be led, L or R can be determined on the basis of the harnesses. In the case of a binding such as shown in FIG. 24 where the free heddle 5A belongs to the first harness 2A, then it is obvious that the new thread 9 must be led through the right-hand gap R; the same applies also to the heddles 5C (5C') of the third harness 2C. If the free heddle 5B belongs to the second frame 2B (FIG. 25) then it is obvious that the new thread 9 must be led through the left-hand gap L; the same also applies to the heddles 5D of the fourth harness 2D. In the method of the invention, the harness on which the free heddle is located can be determined from the distance that the second threading device 22 is able to penetrate into the harnesses.

In the case described in the preceeding paragraph, since there is a well-defined relationship between the location of the heddles 5 and the corresponding drop wires 4, the correct gap (L or R) can clearly be deduced from the row of drop wires in which the fallen drop wires is located.

The mechanism of the invention, together with the associated auxiliary devices, should preferrably be arranged so that when a warp break is repaired the maximum possible thread length is replaced by the new thread 9. This has the advantage that if the break is due to faulty length of thread, the whole of this length will usually be replaced, so that another break does not occur immediately. In order to obtain this advantage, the suction device 11A should preferably be located next to the tensioning bar.

In another embodiment, extra tension can be exerted on the broken warp end 6, in order to test for faulty thread. This tension can be supplied eg. by the suction device 11A.

In another embodiment, a test can be carried out to check whether the thread end to be joined to the new thread 9 is in fact the broken warp end 6 and not the broken end 45 which is attached to the cloth.

In yet another embodiment, the length and/or mass of both warp ends 6 (FIGS. 1–8) and 45 (FIGS. 21–25) can be measured and compared with the mass and/or length of the new piece of thread, which should correspond. If the total length or mass of the warp ends 6 and 45 differs from the length or mass of the new piece of thread, then the new thread 9 has been wrongly joined, or a length of warp thread has been left behind somewhere, or something else has gone wrong. If this happens, the machine is not restarted after the warp repair, and an alert is given to the wearer.

The lengths of the warp ends 6 and 45 can be measured by eg. sucking them into a channel and using optical detectors to measure the lengths sucked in.

This invention is not limited to the example described above or the configurations and operating processes of the rethreading mechanisms shown in the accompanying figures; on the contrary, it can be implemented in various ways while still remaining within the scope of the invention.

We claim:

1. A method for repairing warp thread breaks in a weaving loom in which a broken warp thread is detected by a fallen drop wire of a warp stop motion device, the method comprising:

upon the falling of a drop wire, taking a new warp thread from a supply of warp thread separate from the loom supply of warp thread, and moving the new warp thread to a position between the warp stop motin device and a harness of the loom by means of a rethreading mechanism;

raising the fallen drop wire and threading a first end of the new warp thread through the raised drop wire by means of the rethreading mechanism;

and threading a second end of the new warp thread through a heddle of the harness corresponding to the broken warp thread.

2. The method as claimed in claim 1, including moving the rethreading mechanism across the warp threads of the loom to a position relative to the fallen drop wire before the new warp thread is positioned between the warp stop motion device and the harness.

3. The method as claimed in claim 1, including joining the first end of the new warp thread to an end of the broken warp thread extending from a warp beam of the loom in a tying-in device after the first end of the new warp thread is threaded through the raised drop wire.

4. The method as claimed in claim 1, including threading the second end of the new warp thread through a reed of the loom after the second end of the new warp thread is threaded through the heedle.

and then cutting off the second end of the new warp thread from the separate supply and weaving the second end into the cloth.

5. The method as claimed in claim 1, including:

threading the first end of the new warp thread through the fallen drop wire by threading the new warp thread through a heddle of the rethreading mechanism and inserting the needle through the fallen drop wire;

joining the first end of the new warp thread to an end of the broken warp thread extending from a warp beam of the loom;

withdrawing the needle from the fallen drop wire and swinging the needle through a 180° arc, thereby drawing new warp thread from the separating supply through the needle;

inserting the needle and the second end of the new warp thread through the heddle corresponding to the broken warp thread; threading the second end of the new warp thread through a reed of the loom;

cutting off the second end of the new warp thread from the separate supply and weaving the second end into the cloth; and withdrawing the needle from the heddle.

6. The method as claimed in claim 4, including;

determining where the second end of the new warp thread is to be threaded through the reed by moving a detector means across the width of the reed and locating the space in the reed corresponding to the broken warp thread with the detector means;

spreading apart the warp threads on opposite sides of the space located by the detector means; and threading the second end of the new warp thread through the space in the reed corresponding to the broken warp thread.

7. The method as claimed in claim 1 including measuring the length of the new warp thread between the first and second ends and comparing this length with a predetermined length to ensure the broken warp thread has been properly repaired.

8. A method for repairing warp thread breaks in a weaving loom comprising a tying-in device and in which a broken warp thread is detected by a fallen drop wire of a warp stop motion device, the method comprising:

upon the falling of a drop wire, gripping an end of the broken warp thread extending from a warp beam of the loom at a location between the warp beam and the stop motion device;

inserting the broken end of the warp thread into the tying-in device; raising the fallen drop wire to its normal position;

moving a rethreading mechanism to a position between the warp stop motion device and harness of the loom;

taking a first end of a new warp thread from a separate supply of warp thread and threading the first end through the raised drop wire by means of the rethreading mechanism;

inserting the first end of the new warp thread into the tying-in device after it is threaded through the raised drop wire;

joining the first end of the new warp thread to the broken end of the warp thread in the tying-in device;

removing an end of the broken warp thread extending from the cloth;

threading a second end of the new warp thread through a heddle of the harness corresponding to the broken warp thread;

threading the second end of the new warp thread through a reed of the loom after it is threaded through the heddle; and cutting off the second end of the new warp thread from the separate supply and weaving the second end into the cloth.

9. A method as claimed in claim 8 including:

determining where the second end of the new warp thread is to be threaded through the reed by moving a detector means across the width of said reed and locating the space in the reed corresponding to the broken warp thread with the detector means;

spreading apart the warp threads on opposite sides of the space located by the detector means; and threading the second end of the new warp thread through the space in the reed corresponding to the broken warp thread.

10. A method as claimed in claim 8 including measuring the length of the new warp thread between the first and second ends and comparing this length with a predetermined length to ensure the broken warp thread has been properly repaired.

11. A rethreading mechanism for repairing warp thread breaks in weaving looms in which a broken warp thread is detected by a fallen drop wire from a plurality of drop wires of a warp stop motion device, the rethreading mechanism comprising:

a new warp thread supply separate from a warp thread supply of said loom;

a first threading device supplied with new warp thread from said separate supply and arranged to thread a first end of a length of new warp thread through said drop wires of said warp stop motion device;

a second threading device supplied with new warp thread from said separating supply and arranged to thread a second end of said length of new warp thread through heddles in a harness of said loom; and a positioning mechanism arranged to position said first and second threading devices relative to said loom by moving said first and second threading devices vertically and horizontally between said warp stop motion device and said harness of said loom.

12. A mechanism as claimed in claim 11 wherein said first threading device comprises:

a hollow tube extending parallel to the warp threads of said loom, with an end of said tube nearest said drop wires being closed off and with an opening in the side of said tube adjacent said closed end, and with the opposite end of said tube being connected to a suction device;

and a channel extending through said first threading device underneath said tube, said channel being arranged to supply said first end of said length of new warp thread to said opening in said tube.

13. A mechanism as claimed in claim 11 wherein said second threading device comprises a V-shaped recess extending into said second threading device parallel to the warp threads of said loom, with the vertex of said recess having a width equal to the width of a heddle, and one side of said recess having a new warp thread channel extending thereto and the opposite side of said recess having a suction channel extending thereto.

14. A mechanism as claimed in claim 11 wherein said positioning mechanism comprises a pantograph linkage assembly arranged to position said first and second threading devices relative to said loom.

15. A mechanism as claimed in claim 14 further comprising:

a first guide that is stationary relative to said loom;

a first base slidably mounted on said first guide and arranged to move vertically relative to said loom;

a second guide pivotally mounted to said first base;

an angular setting device mounted between said second guide and said first base and arranged to adjust the angle of said second guide relative to said loom;

a second base slidably mounted on said second guide; and said pantograph linkage assembly being mounted on said second base.

16. A mechanism as claimed in claim 11 wherein said positioning mechanism comprises a parallelogram linkage assembly arranged to position said first and second threading devices relative to said loom.

17. A rethreading mechanism for repairing warp thread breaks in weaving looms in which a broken warp thread is detected by a fallen drop wire from a plurality of drop wires of a warp stop motion device, the rethreading mechanism comprising:

a new warp thread supply separate from a warp thread supply of said loom;

a threading device supplied with said new warp thread from said separate supply and including a needle arranged to swing through an arc of 180° between a position where said needle points at said warp stop motion device and a position where said needle points at a harness of said loom, said needle having an eye at one end arrange to receive said new warp thread supplied to said threading device;

and a positioning mechanism arranged to position said threading device relative to said loom by moving said threading device parallel to the warp threads of said loom.

* * * * *